US006524355B1

(12) United States Patent
Jenkins

(10) Patent No.: US 6,524,355 B1
(45) Date of Patent: Feb. 25, 2003

(54) EXERCISE DEVICE

(76) Inventor: Thomas Jenkins, 320 Robert Street, Toronto, Ontario (CA), M5S 2K8

( * ) Notice: Subject to any disclaimer, the term of this patent is extended or adjusted under 35 U.S.C. 154(b) by 0 days.

(21) Appl. No.: 09/542,924

(22) Filed: Apr. 4, 2000

(51) Int. Cl.[7] ..... A63B 22/04

(52) U.S. Cl. ..... 48/52; 601/24; D21/671; D21/690

(58) Field of Search ..... 482/23, 52, 51, 482/142, 123, 130, 140, 148; 601/23, 24, 25; D6/501, 380, 500; D21/662, 671, 686, 690, 694, 695, 696; 297/239, 463.2, 93, 439, 461, 462, 438, 423.45; 248/188.2, 188.8; 108/51.1, 11, 12, 19, 155.7, 91, 93, 901

(56) References Cited

U.S. PATENT DOCUMENTS

| | | | | | |
|---|---|---|---|---|---|
| 2,936,826 | A | * | 5/1960 | Reineman | 297/239 |
| 3,053,493 | A | * | 9/1962 | Stafford | 297/239 |
| 3,561,818 | A | | 2/1971 | Lohmeyer | 297/239 |
| 3,637,256 | A | | 1/1972 | Harty | 297/248 |
| 3,822,078 | A | | 7/1974 | Spadolini | 297/140 |
| 3,944,280 | A | | 3/1976 | Keeler | 297/239 |
| D254,345 | S | | 3/1980 | Labor | D6/1 |
| D288,950 | S | | 3/1987 | Wilson | D21/191 |
| 5,158,512 | A | | 10/1992 | Irwin et al. | 482/52 |
| D342,106 | S | | 12/1993 | Campbell et al. | D21/191 |
| 5,275,579 | A | | 1/1994 | Wilkinson | 482/52 |
| 5,290,210 | A | * | 3/1994 | Hand et al. | 482/51 |
| 5,318,489 | A | | 6/1994 | Irwin | 482/52 |
| 5,512,026 | A | * | 4/1996 | Wilkinson | 482/52 |
| 5,690,588 | A | * | 11/1997 | Lavore | 482/58 |
| 5,997,094 | A | * | 12/1999 | Cvek | 297/452.15 |
| 6,132,338 | A | * | 10/2000 | Shifferaw | 482/30 |

OTHER PUBLICATIONS

Pamela Sebastian, Briefs, Fall of 1998.

* cited by examiner

*Primary Examiner*—Stephen R. Crow
*Assistant Examiner*—Tam Nguyen

(57) ABSTRACT

An exercise device comprising: a support platform, to support a user, a frame, extending below the support platform, to support the support platform, and a base-engaging section, positioned below the frame, and being sized and shaped to engage a step-riser, wherein the support platform may be set to one or more predetermined heights above a flat surface to accommodate users of different sizes, by said exercise device being placed on the flat surface or one or more step risers.

19 Claims, 6 Drawing Sheets

EXERCISE DEVICE

FIELD OF THE INVENTION

This invention relates generally to physical fitness, and more particularly to the field of exercise equipment.

BACKGROUND OF THE INVENTION

Fitness classes in which an instructor leads a group in a variety of routines are a popular form of exercise. Similarly, videos showing fitness routines that enable individuals to conveniently exercise at home are also popular. The exercises presented are often aerobic in nature, i.e. vigorous movement intended to raise the heart rate. Exercises directed to improving strength or flexibility may also be performed, usually at a slower pace.

Whether given live or by video, in most cases the participants or viewers are expected to follow and keep up with the pace set by the instructor. A drawback to this arrangement is that it compels the participants as a group to be at more or less the same level of health, fitness, or ability. As a result, people who are injured, disabled, aged (seniors), obese, or otherwise less fit may be unable to maintain the necessary level of exertion for the extended periods required. These people may be forced to forego some portion of the exercise routine, and therefore may fail to receive its full benefit.

Some people may also find it difficult or impossible to remain standing for all or part of the class. This is a problem since many if not most fitness class routines are done from a standing position. Again, the people affected may have to sit out for part of the class. Further, those people whose injuries or disabilities preclude them from standing unaided, such as people who have suffered a sprained ankle or broken leg, or who are in wheelchairs, are generally unable to participate at all in exercise classes or videos directed at the general population.

Exercisers who are less fit and become tired or unable to keep up are of course free to rest by standing, if possible, or by sitting down. However, as noted this approach can be dissatisfying since while resting the exerciser is not deriving any exercise benefit. In addition, sitting on the floor without any support can be uncomfortable or stressful. It can also be difficult to return to a standing position when the person wishes to resume exercise. These considerations are particularly pertinent where, as noted, the people involved are already weaker and less able than the other exercisers.

Another option is to choose a less strenuous routine. However, there may not be a class or video available with the same exercise approach or routine, or led by the same desired instructor. Even if available, such a class may be too easy, and therefore not provide sufficient exercise benefit. As well, the fundamental problems of some exercises being too hard to follow, and the necessity to remain standing, still remain.

Yet another approach is suggested by the popularity of stepping classes, since stepping is an exercise that accommodates exercisers of differing ability, to some extent. Stepping is a highly aerobic exercise that essentially consists of stepping on and off a special platform. The height of the platform can be adjusted for the needs of each individual by selectively adding one or more pairs of stackable risers underneath the platform. The type of platform and risers in common use are described in U.S. Pat. Nos. 5,318,489 and 5,158,512 to Irwin. Another design for an aerobic climbing step/bench is shown in U.S. Pat. No. 5,275,579 to Wilkinson.

In practice, advanced exercisers may use several riser-pairs to increase the height of the platform and present a more challenging exercise. Similarly, less advanced or weaker exercisers may use only one riser-pair, or even none. In this way, a stepping class can accommodate a variety of users. The popularity of stepping, along with the stackable nature of the platforms and risers, which allows them to be compactly stored, has led to a fairly widespread availability of stepping equipment in health and fitness clubs. Exercisers at home who use a step-class video can purchase their own platform and risers.

However, although stepping incorporates some adaptability for individual exerciser ability, again it is not a universal solution. While popular with some exercisers, stepping is still just one particular exercise that doesn't appeal to everyone. Further, it is by nature very strenuous, even where the exerciser uses only one riser-pair, or even no risers at all. The intensity of the exercise, as well as the self-evident requirement for continuous standing suggests that stepping is likely to have only limited appeal to less fit individuals, and offers no solution at all to individuals of any fitness level who have difficulty standing.

Yet another approach might be to provide some sort of supporting device for use during exercise. One possible device is illustrated in a design patent issued to Wilson, U.S. Pat. No. Des. 288,950, for an exercise stand. Wilson shows a stand with a seat, a backrest, a crossbar and two wide handlebars, and a two-step footrest that retracts under the seat. A figure is shown leaning against the exercise stand, using the crossbar for support. However, the device appears to be awkward, cumbersome, and somewhat complicated.

Another suggested device is U.S. Pat. No. Des. 342,106, issued to Campbell for an exercise chair. This shows a metal-frame chair where both the seat and backrest are wide, long, and padded. The chair is outfitted with a pulley-like device that retracts into a large metallic enclosure mounted under the seat, is anchored at the back, and has two hand stirrups. The Campbell chair appears to be heavy and meant to function as an exercise machine in its own right. The device does not appear to offer any particular utility for exercise class participants.

As a result, there does not appear to be any practical method or structure that enables general fitness classes or routines to be more inclusive of exercisers that are less fit or who have difficulty standing.

SUMMARY OF THE INVENTION

What is required is an exercise device which overcomes the problems faced by less fit, injured, or disabled people who wish to exercise and take fitness classes. Most particularly, the device should function to support exercisers in response to and to the extent required by their individual needs. That is, the device should support people who cannot stand at all and who need full support throughout the class, as well as those whose need is for temporary support at various intervals. The exercise device should be adjustable so that it can be comfortably used by exercisers of various heights and body shapes.

While using the device, exercisers should be able to participate to the full extent of their desire and ability. This means that exercisers at the highest fitness level who cannot stand due to injury should still be able to perform high intensity workouts and derive full exercise benefit while using the device. Permanently disabled people who cannot stand but are otherwise fit would similarly benefit. More conventional users, including seniors, the obese and less fit, should be able to exercise at a graduated or less intense level of effort, commensurate with their ability and condition, even while using the device to rest from the rigour of the regular class. The device should also provide this latter group of users with a more satisfying way to rest than by standing unsupported or by sitting on the floor. Moreover, it would be advantageous to be able to return to a standing position and rejoin the class with less effort than that needed to stand up from a sitting position on the floor.

In this way, the exercise device should expand class participation beyond the conventional "all or nothing" experience, whereby the exerciser either fully participates, or rests by standing or sitting and obtains no exercise benefit. As noted it should also allow for the inclusion of people who would otherwise not be able to participate. The exercise device thereby should enable everyone who wishes to exercise to work-out at their own appropriate pace, and provide improved health benefits.

Finally, it would be advantageous if the exercise device were lightweight and capable of compact storage, so that it would be convenient for an exercise club to keep a sufficient number of devices for its members available on its premises, and so it would be convenient for home use.

Accordingly, there is provided an exercise device comprising:

a support platform, to support a user;

a frame, extending below the support platform, to support the support platform; and a base-engaging section, positioned below the frame, and being sized and shaped to engage a step-riser;

wherein, said support platform may be set to one or more predetermined heights above a flat surface to accommodate users of different sizes, by said exercise device being placed on the flat surface or one or more step-risers.

BRIEF DESCRIPTION OF THE DRAWINGS

Reference will now be made, by way of example only, to preferred embodiments of the invention as illustrated in the attached figures.

DETAILED DESCRIPTION OF THE PREFERRED EMBODIMENTS

Figure 1:
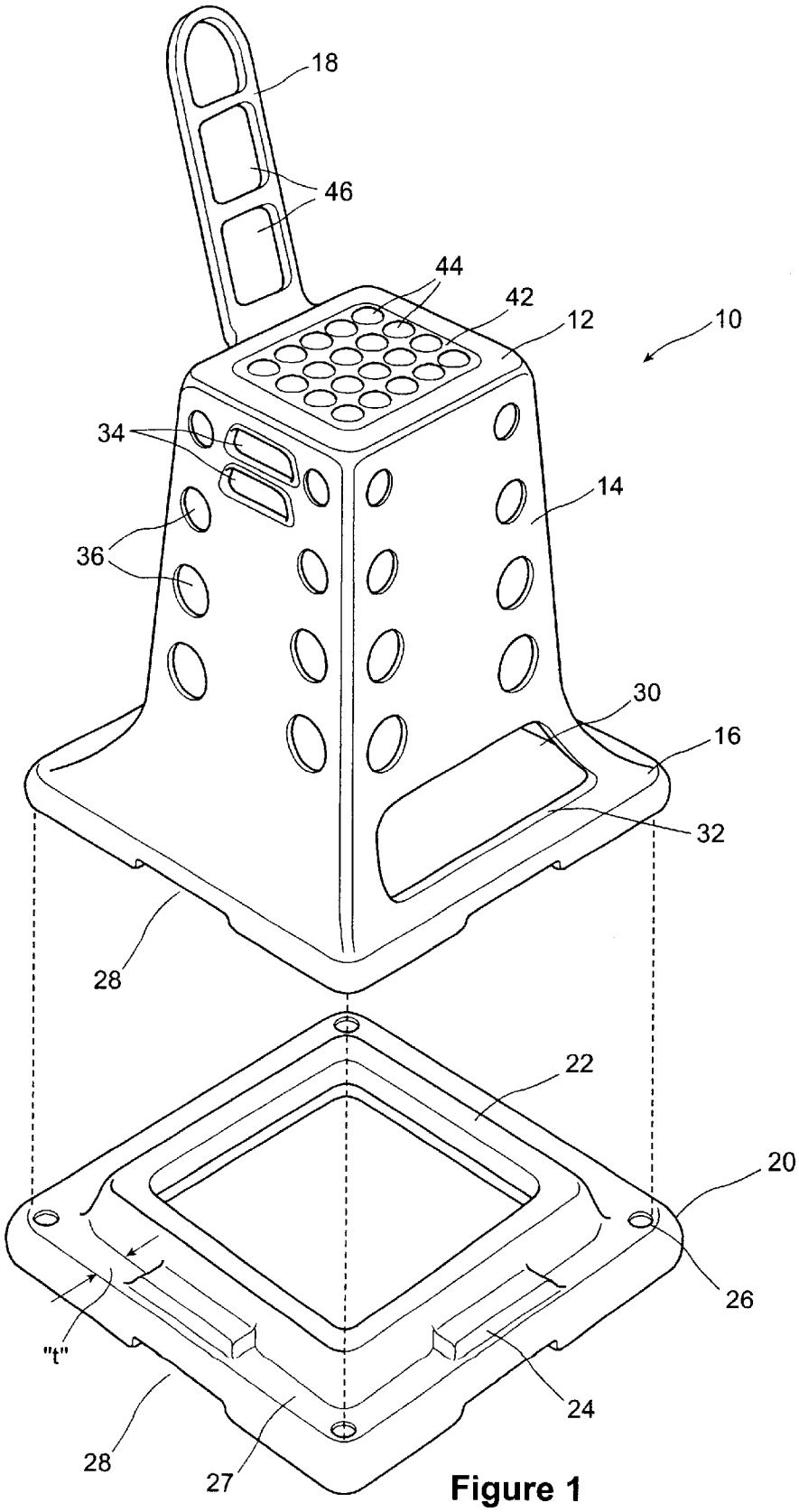
FIG. 1 is a perspective view of the exercise device or chair of the present invention and a step-riser.

FIG. 1 shows a perspective view of a preferred embodiment of the exercise device or exercise chair of the present invention, and a step-riser. The exercise chair is generally indicated with reference numeral 10, and comprises a support platform or seat 12, a frame 14, and a base-engaging section or base 16. The chair 10 may also include a backrest 18. The step-riser is indicated with reference numeral 20. For clarity, in FIG. 1 the exercise chair 10 is shown suspended in air above the step-riser 20, with the relative alignment of the chair and step-riser indicated by dotted lines.

The support platform or seat 12 provides a surface to support a user or exerciser, on which the exerciser can sit. The frame 14 maintains the seat 12 a minimum distance above the ground so that the user's legs can be comfortably extended. The base 16 maintains a stable and secure connection with the ground, and the backrest 18 provides a surface to support a back of the user sitting and exercising in the exercise chair 10.

The step-riser 20 shown in FIG. 1 is a representative sample of the type of device that is commonly provided to perform "step" or "stepping" exercise routines. To perform stepping exercises there is usually provided a step platform (not shown) and one or more pairs of step-risers 20, both of which items are usually constructed from a high strength durable plastic. The step platform is generally sized and shaped to fit snugly on top of a pair of adjacent step-risers 20. The step platform thereby forms a flat surface above the floor on which the exerciser steps up and down to perform the stepping exercise routines. The step-risers 20 are stackable, so the height of the step platform above the ground can be set to a predetermined height by selecting a specified number of step-riser pairs.

In practice, the user engaging in stepping exercise selects the particular configuration of step equipment that is appropriate for his or her height and exercise ability. The user may place the step platform directly on the ground and not use any step-risers; more commonly the user may choose to mount the step platform above one, two, or more step-riser pairs.

Due to the general acceptance and popularity of stepping exercise, stepping equipment and in particular step-risers have become widely available, particularly at fitness clubs.

Figure 2:
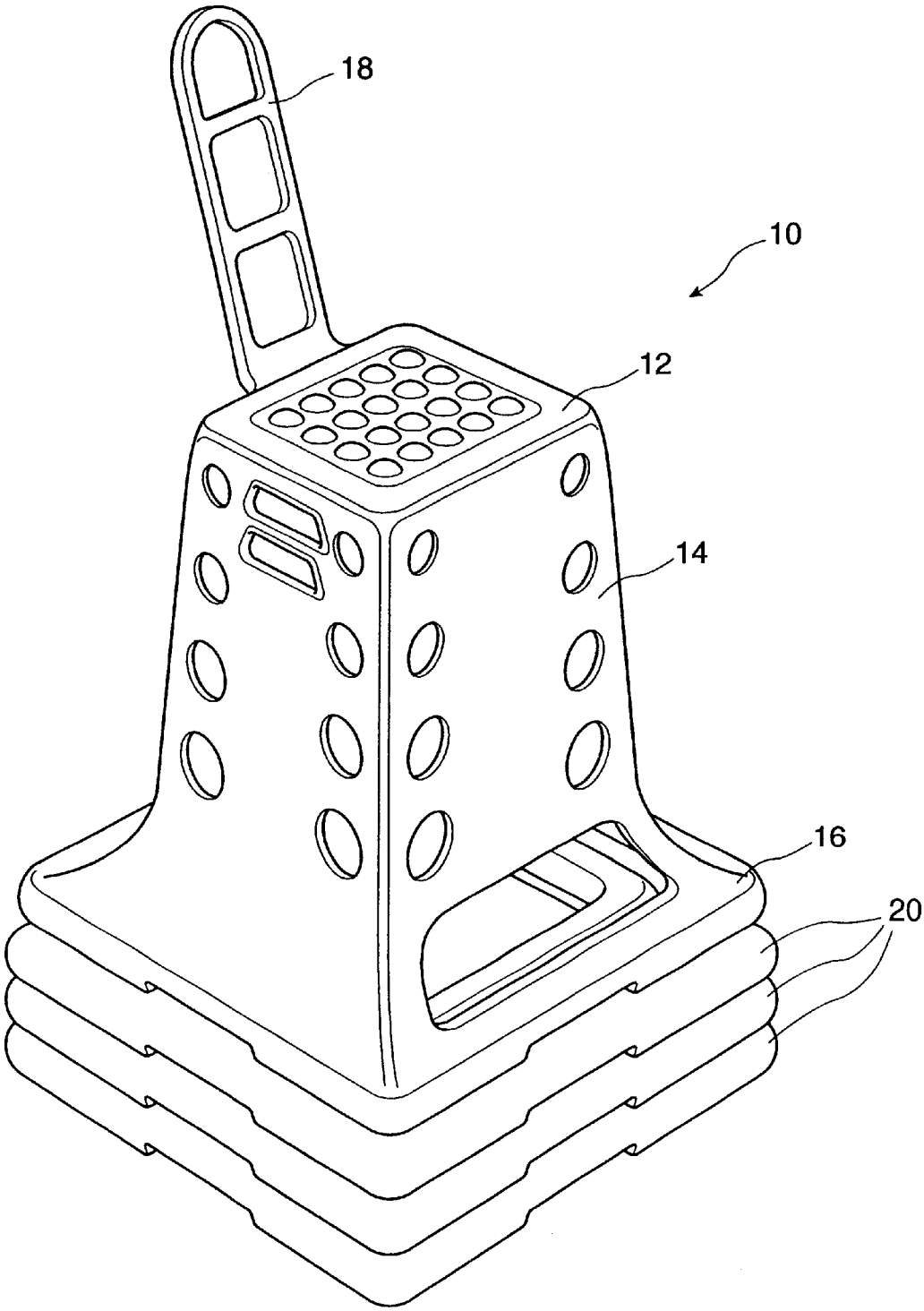
FIG. 2 is a perspective view of the exercise chair of the present invention mounted on a stack of three step-risers.

Returning to the exercise chair 10 of FIG. 1, it may be seen that the base 16 is generally broad and flat and accordingly provides a stable base for the chair 10 when the chair 10 rests on the ground or other flat surface. Additionally, it is a feature of the present invention that the base 16 is also sized and shaped to engage a step-riser 20. This is shown in FIG. 1 by the dotted lines connecting the three visible corners of the base 16 with the corresponding corners of the step-riser 20. Since the step-risers 20 are themselves stackable, it can be appreciated that the chair 10 can be mounted on top of one step-riser or a stack of step-risers, as desired. This is shown in FIG. 2, which shows the chair 10 mounted on a stack of three step-risers 20.

It can be appreciated that by selecting the number of step-risers to place under the base 16, including placing none if desired, the exercise chair 10 of the present invention may be set to a predetermined height above the ground.

The design of a preferred embodiment of the base 16 may be realized by examination of the step-riser 20 of FIG. 1. It may be seen that the step-riser 20 has a central ridge 22 occupying all four sides of the step-riser, a side-bar 24 on each side, a footpad inlay 26 in each corner, and a side-indentation 28 in the middle of each side, at the bottom. Not shown in FIG. 1 are footpads placed in each corner of the bottom of step-riser 20, directly below the footpad inlays 26. FIG. 1 also shows that there is a certain thickness "t" between the generally sloped edge of step-riser 20 and the generally sloped bottom edge of the central ridge 22, which is riser-ledge 27.

The side-indentation 28 is positioned directly below the side-bar 24 on each side, and is slightly wider than the side-bar 24. The side-indentation 28 is sized and shaped to facilitate the stacking of the step-risers 20, so that when one step-riser 20 is mounted on top of another, the side-indentation 28 of the top step-riser nestles onto the side-bar 24 of the lower step-riser. Similarly, the footpad in each bottom corner of the top step-riser will nestle into the footpad inlay 26 of the bottom step-riser. Also, not shown in FIG. 1, the bottom of the step-riser 20 is sized and shaped so that the central ridge 22 of the bottom step-riser nestles into the bottom of the top step-riser. In this way, as discussed, the step-risers 20 in common use can be mounted or stacked on top of one another to form a snug fit.

It may be seen that the step-riser 20 of FIG. 1 is generally rectangular, and in particular has a square shape, in that all four sides are of equal length. It can be appreciated that step-risers that are not square or that have a different shape from that shown in FIG. 1 may also be used, and that the base 16 of the present invention may be modified accordingly.

It can now be appreciated how a preferred embodiment of the base-engaging section 16 may be sized and shaped to engage a step-riser such as the commonly used step-riser 20 described above. The base 16 is preferably square, with a side-length comparable to that of the step-riser 20. It is desirable for the base 16 to have footpads (not shown) in each bottom corner, to nestle onto the footpad inlays 26 on the step-riser 20. Similarly, it is useful to have side-indentations 28 in each side of the bottom of base 16 to nestle with side-bars 24 in the contacting step-riser. The bottom of the base 16 may also be constructed to have a base-ledge 29 with perimeter thickness of approximately "t" in length, and with a gentle slope, to engage the upper surface of the step-riser 20. Further, a rubber strip along the perimeter of the bottom of the base 16 may be added to reduce the chance of slippage. It can be appreciated that the design aspects of the base 16 described above are by way of example only, and that these design aspects may be suitably varied to accommodate the specific details of any particular step-riser 20.

In determining the appropriate height of the exercise chair, it is believed that the chair will be more comfortable and effective if the exerciser's feet can touch the floor when the exerciser sits with his or her back against the backrest 18. Feeling the floor provides a familiar sensation, a connection with the ground, and an enhanced sense of security. Conversely, if the exerciser's feet dangle above the floor there may be pressure on the bottom of the thighs and a cut-off in circulation to the user's legs. Being able to touch the ground is also helpful for certain exercises which involve pushing off with the feet.

The height of the device may be set by each user according to personal preference. Exercisers in good condition may prefer greater extension, with only the ball of their foot reaching the ground. More frail users may prefer the more solid feel of full contact with the ground.

It has been generally found that a frame 14 height of between 17 and 19 inches, preferably 18 inches, provides adequate results. This is high enough to accommodate people up to about 5 foot, 5 inches tall without the need for step-risers, and is also low enough for people as short as 5 feet to reach and sit on comfortably. Adding step-risers to the base 16 adds approximately 2 inches in overall height for each step-riser. By way of example, a person 5 feet 10 inches in height would likely select one or two step-risers, depending on that person's personal preference, and would thereby be seated approximately 20 or 22 inches above the ground. It can be appreciated that other sizes of frame 14 may also be used without departing from the principles of the present invention.

The frame 14 of the exercise chair 10 of the present invention is shown in FIG. 1 as widening progressively from the top (where it meets the seat 12) towards the bottom (where it meets the base 16). It can be appreciated that this flared or pyramidal design has the advantage of providing a more stable platform for the user. It has been found that having a frame 14 with an upper perimeter or seat 12 approximating the dimensions of the central ridge 22, and a lower perimeter approximating the outer dimensions of the step-riser 20 produces adequate results, providing both adequate stability and a seat 12 that is comfortably sized.

Further examination of the frame 14 in FIG. 1 shows a front aperture 30 positioned on the bottom of the front portion of frame 14. The front aperture 30 provides additional kicking space for the user, and also creates a convenient foot rest 32. The front aperture 30 may be conveniently sized to extend approximately the width of the front side of the frame 14, and may have a height that allows sufficient kicking room. A front aperture 30 having dimensions of about 9½ inches wide and a minimum of 4 inches high has been found to provide adequate results. It can be appreciated that while the design of the preferred embodiment of FIG. 1 takes the form of an actual aperture or hole, in other embodiments-of the present invention this element may simply be an open space inherent in the design itself.

Another useful design aspect of the frame 14 shown in FIG. 1 are hand-grips 34. The hand-grips 34 provide a convenient handle for the user sitting in seat 12 to grip, to enhance stability during exercise. In the embodiment of FIG. 1 the hand-grips 34 are shown as two sets of apertures on the upper part of the sides of the frame 14 (only the right side is visible in FIG. 1). The hand-grips 34 may be provided with a rubber or foam cushioned lining for user comfort.

Two hand-grips 34 are shown on each side to accommodate different arm lengths, but of course there may be fewer or more hand-grips as desired. It can also be appreciated that rather than the apertures shown in FIG. 1, the hand-grips 34 may take on different forms depending on the particular embodiment of the exercise chair 10. For example, the hand-grips 34 could be in the form of one or more padded bars projecting from the frame 14. Additionally, the hand-grips 34 could be hinged so that they could be pulled into a position parallel to the front and back of the chair, to provide other stretches and exercises for the sitting user, and also for users standing in front or behind the chair 10.

The preferred embodiment of FIG. 1 also shows a series of frame apertures 36 shown running vertically on either end of the sides and front of the frame 14 in FIG. 1. The frame apertures 36 are shown as circular in shape, increasing progressively in size from top to bottom. In this particular embodiment of the exercise chair 10 the frame apertures 36 reduce the weight of the chair without unduly affecting its strength. This has the advantage of making the chair easier to carry. The frame apertures along the top have a further benefit in that they conveniently allow one or more straps, not shown, to be passed under the seat 12. These straps may then be secured over the lap of the exerciser to hold him or her securely in the seat 12 during the exercise period. Similarly, the lower frame apertures allow calf or ankle-securing straps to be secured, if desired. The use of straps is likely to be of particular benefit to permanently disabled users, some of whom may be familiar with strap fasteners from wheelchair sports activities. It can also be appreciated that if the frame apertures 36 are not present in another embodiment of the present invention, the strap-fastening function may be fulfilled by other means such as hooks or loops.

Figure 3:
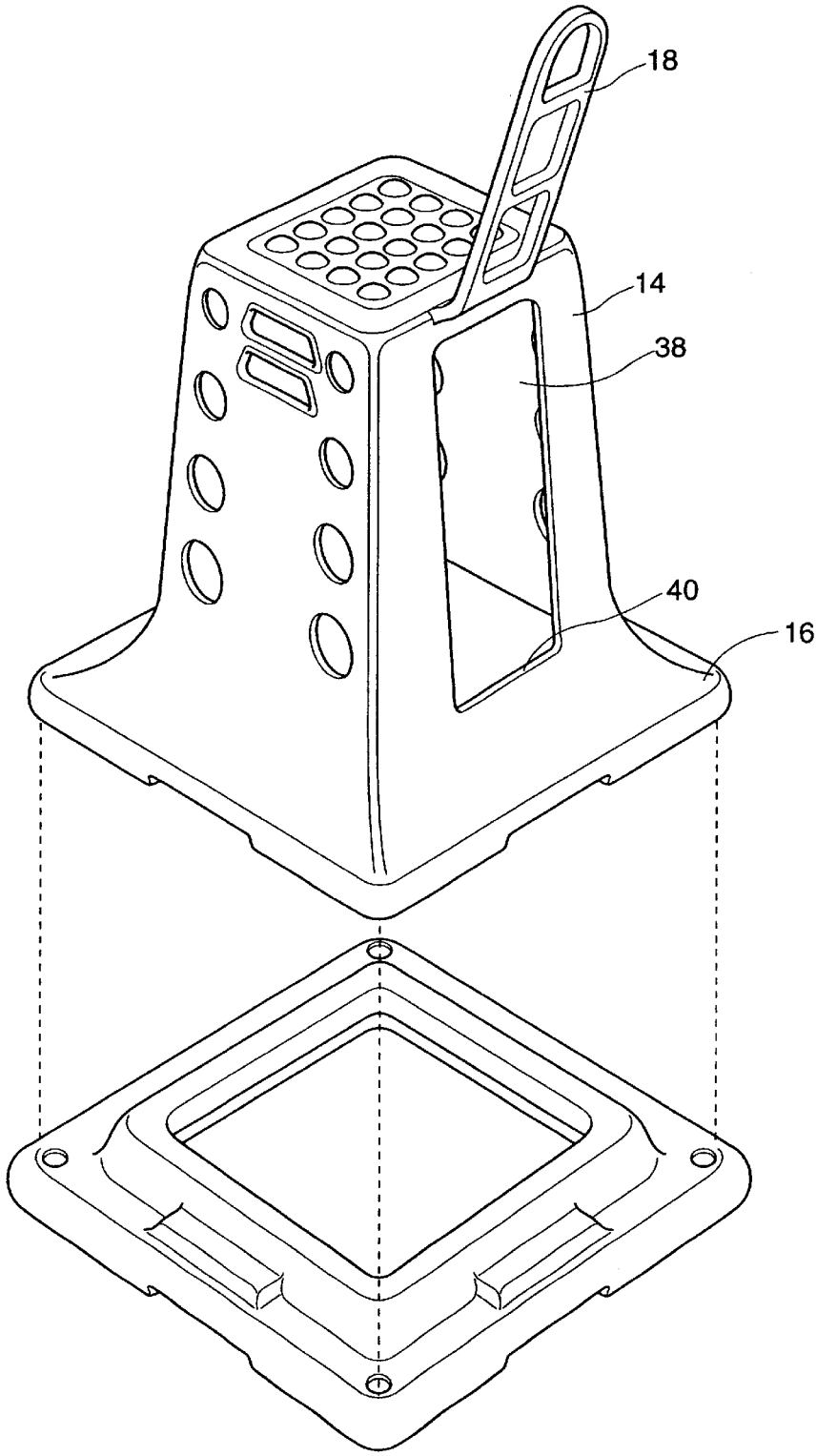
FIG. 3 is a rear view of the exercise chair of the present invention and a step-riser.
Figure 4:
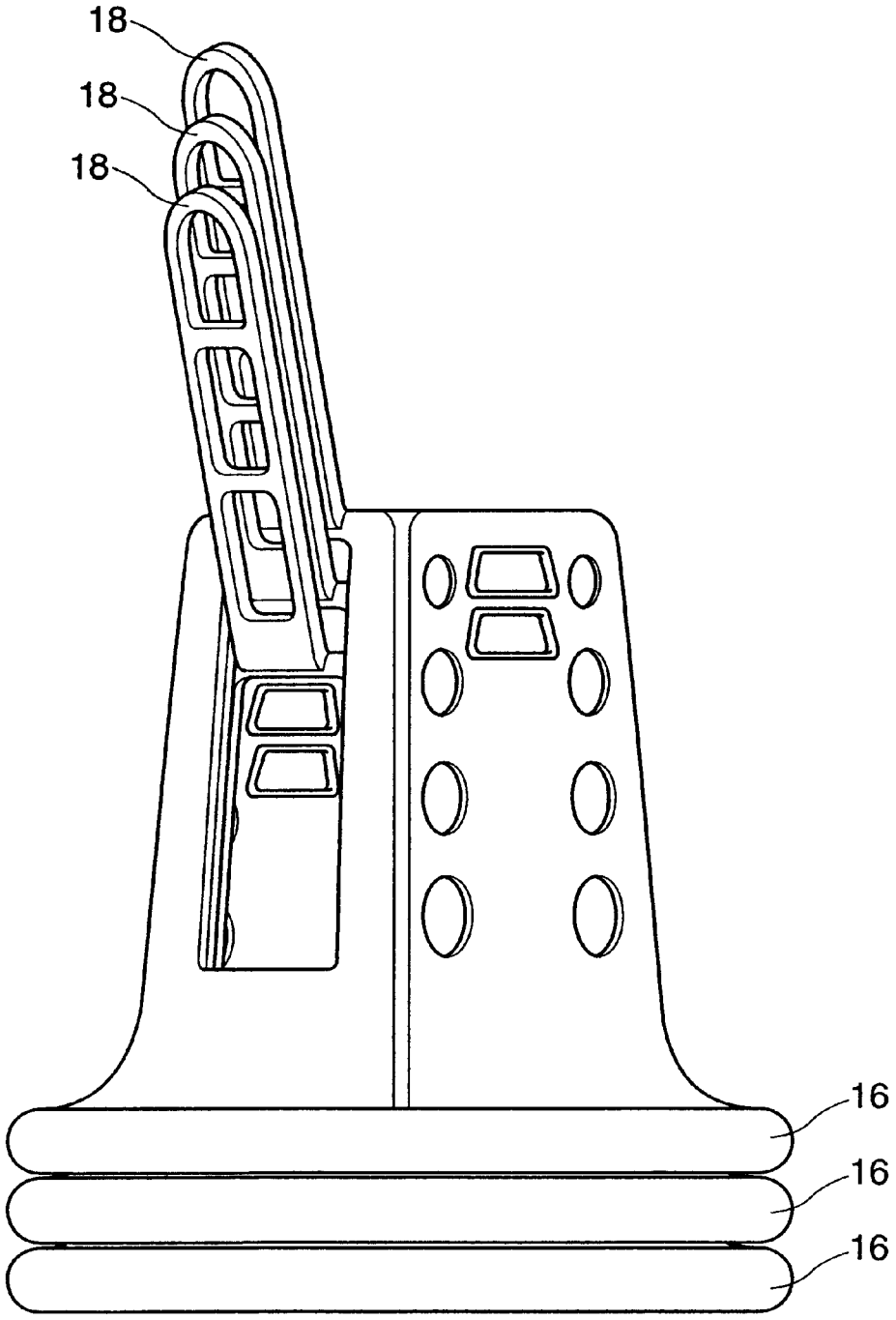
FIG. 4 is a perspective view of a group of three exercise chairs of the present invention, where the chairs are stacked on top of one another.

A rear or back view of frame 14 of chair 10 is shown in FIG. 3. This side is distinguished by a single large back aperture 38 that extends from the top of the frame 14 just below the backrest 18 to a back footrest 40, positioned closer to the base 16. The back aperture 38 is sized and shaped to enable two or more exercise chairs 10 of the present invention that have a backrest 18 to be nested, or stacked on top of one another. This feature is shown in FIG. 4, which shows a stack of three exercise chairs 10. The back aperture 38 is accordingly sized to have a width at least slightly wider than the backrest 18, so that the backrest 18 of the chairs occupying a lower position in the stack can be accommodated. It can be appreciated that the support platform 12, frame 14, base 16, and backrest 18, as well as the back aperture 38, are all sized and shaped to enable two or more exercise chairs 10 of the present invention to be nested, or stacked on top of one another. It can also be appreciated that an embodiment of the exercise chair without the backrest 18 and back aperture 38 would still be nestable as long as the support platform 12, frame 14, and base 16 are sized and shaped to permit an exercise chair to nest or stack inside another. In particular, it can be appreciated that this may be achieved where the support platform 12, frame 14, and base 16, define a hollow inner space.

The height of the back footrest 40 will vary depending on the size of the back aperture 38. It can be appreciated that as this aperture is reduced in size the back of the frame 14 will acquire a greater structural strength, but the chair will also be heavier and have less space available for the backrests of other chairs in the stack. It has been found that a back aperture 38 about 8½ inches wide and about 10 to 14 inches high provides reasonable results. It can be appreciated that the ability of the exercise chair 10 to be stored in a stacked arrangement is a beneficial feature of the present invention, since it makes it easier for fitness clubs to store a sufficient number of the exercise chairs for their members in a compact space.

Returning to FIG. 1, the support platform or seat 12 is preferably sized and shaped to be comfortable for a variety of users, for both sitting and exercising. As discussed, it has been found that closely following the outer dimension of the central ridge 22, which is approximately 12 inches on each side, for a square step-riser, provides satisfactory results, and has the added benefit of allowing the frame 14 to have an outward taper, which enhances stability. The seat 12 may have a different overall shape, for example circular rather than rectangular. In that case the frame 14 might have a conical shape. However it has been found that a rectangular shape for the seat 12 (with corresponding four sides for frame 14) is preferable in that it is more compatible with the shape of the base 16, which as noted is sized and shaped to accept a common rectangular step-riser 20. It may also be noted that a seat which has a curved edge and/or is larger than necessary may be less comfortable.

The seat 12 shown in FIG. 1 has a sitting surface 42 on which are embedded a plurality of raised nodes 44. The sifting surface 42 represents any surface that provides comfort and/or reduces slipping by the user. A preferred material for this surface may be rubber, foam, or any other firm, cushioned material that minimizes slipping. For example, the type of material used for seat or handlebar padding commonly used in fitness equipment such as fitness bicycles maybe appropriate. The raised nodes 44 may be small bubbles or projections formed on the surface. The cushioned materials suggested above can often be produced by a simple die or extrusion process that allows for the production of such projections. It can be appreciated that a sitting surface 42 constructed of other materials than those described may also fulfill the function of increased comfort or reduced slipping, without having an element corresponding to the raised nodes 44.

The backrest 18 shown in FIG. 1 should be rigid and firmly attached to the chair 10, to provide support both to a sitting exerciser, as a backrest, and to a standing exerciser making use of the backrest as a support post for stretching and exercise. The backrest 18 is preferably designed to have a height and width of sufficient dimension to comfortably support the back of a sitting user, while at the same time being narrow enough to not obstruct the user's swinging arms in exercise. The height of the backrest 38 is preferably at about the midback, or above the small of the back and below the shoulder blades. It has been found that a backrest 18 approximately 8 inches wide and 15 inches high provides satisfactory results.

Also shown in the backrest 18 of FIG. 1 are hand grips in the form of three backrest apertures 46. The backrest apertures 46 provide a convenient gripping surface for exercisers standing behind the chair 10, and may also be gripped by seated exercisers performing a deep rotation stretch. The backrest apertures 46 as shown in FIG. 1 also have the benefit of offering both horizontal and vertical gripping surfaces. It can be appreciated that other embodiments of the backrest 18, backrest apertures 46, and gripping surfaces associated with the backrest 18 are also possible.

Figure 5:
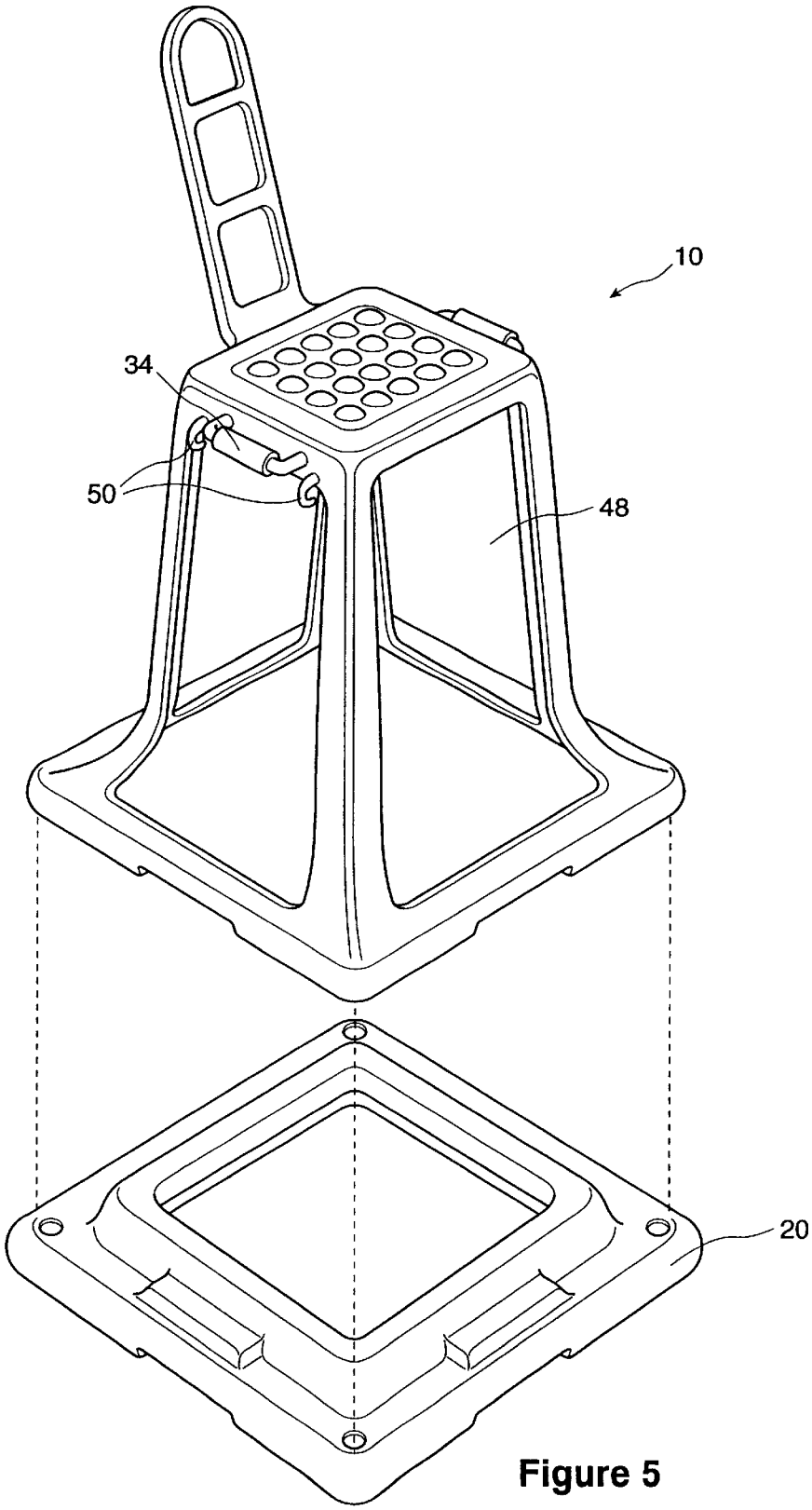
FIG. 5 is a perspective view of another embodiment of the exercise chair of the present invention and a step-riser.

An alternate embodiment of the present invention is shown in FIG. 5. In this embodiment all four sides of the frame 14 have a single large aperture 48 similar to the back aperture 38 in the preferred embodiment of FIG. 1. It can be seen that the large aperture 48 in this embodiment is larger than the front aperture 30 of the first embodiment, shown in FIG. 1. While there are no frame apertures 36, this embodiment has the advantage of being lighter than the embodiment of FIG. 1 because there is less material in the sides and front of frame 14. Strap hooks 50 are added to enable straps to be tied when desired. The hand-grips 34 are constructed as a projecting, padded cross-bar rather than as an aperture cut out of the frame material. It can be further appreciated that this particular embodiment of the hand-grips 34 may need to be made retractable or hinge-mounted to prevent any interference with the nesting or stacking feature of the exercise chairs 10. Alternatively, it may be convenient to leave some additional material at the top of each side of the frame 14, so that apertures for hand-grips 34 and strap hooks 50 can be stamped out, as before.

The exercise chair 10 is preferably constructed from a material that is lightweight yet strong, inexpensive, and flexible to manufacture. Plastics in general, and PVC plastic in particular are widely available preferred materials that meet these criteria. For example, adequate results have been obtained using PVC plastic of about the same thickness as the step-risers. It can be appreciated that a wide choice of different plastics of varying thicknesses may be used, as long as the resulting structure is thick or rigid enough to support the weight of different users, but not so thick that weight or cost would rise beyond a reasonable level. It can be appreciated that the thickness of the chair material relates to the choice of material, since different materials will have different rigidity characteristics.

The use of plastic as a construction material of the exercise chair 10 has a variety of other benefits as well. Plastic is hygienic, easy to clean and wipe off. Exercise chairs fashioned from plastic could be conveniently manufactured as single piece units, and in a variety of colours. This could be helpful in promoting the acceptance of the exercise chairs, as they would have the same sporty look as the colorful step-risers. Further, many suitable sitting surfaces 42 such as those made of rubber or foam could be readily glued to the seat 12 of a plastic exercise chair. Additionally, many of the features of the present invention shown as apertures in the embodiment of FIG. 1 could be easily formed out of the plastic used to manufacture a plastic exercise chair 10.

Of course it can be appreciated that materials other than plastic may also be used to construct the exercise chair 10. For example, a metal chair constructed out of metallic bars or rods may be suitable for the preferred embodiment shown in FIG. 5. Other materials may also be appropriate as long as the resulting chair is reasonably lightweight, safe, stackable, and engageable with a step-riser so that users can set the chair to a predetermined height.

The operation of the exercise chair 10 can now be described. Prior to commencing exercise, the user retrieves the chair and selects the number of step-risers to use, if any. In a fitness class, the user may then carry the exercise chair and step-risers from the storage area to the workout area. As noted, the exercise chair is constructed from lightweight substances such as PVC plastic, and is also sized and shaped to minimize excess material. It can therefore be appreciated that for most people the exercise chair 10 should be reasonably easy to carry. Upon arriving at the workout area the user stacks the selected step-risers on top of one another, and then mounts the exercise chair 10 on top of the top step-riser in the stack, to engage the base 16 with the step-riser 20. Other apparatus, such as an exercise mat or a conventional step platform, may also be set up as well.

During the fitness class the user can make use of the exercise chair to any extent or degree of participation desired, and for any one of a wide variety of functions. For example, the user may choose to access the exercise chair sporadically, or alternatively may use the chair for the entire duration of the class. Those users who have difficulty standing for any length of time will likely choose to remain seated on the chair throughout the class. Functionally, the exercise chair may be viewed as a support structure on which to rest, a stretching aid, or an exercise medium for strength and aerobic fitness in its own right. Further, the chair can be used from either a standing or a sitting position.

The exerciser can rest by sitting on the chair or by leaning against the seat or backrest while standing. It can be appreciated that with the preselected step-risers providing a customized fit, the chair will generally be set to a height that is comfortable in any rest position. As an example of a standing stretch, the user could hold the backrest with one hand for support, stand on the same-side leg, and hold the other, bended leg with the other hand, thereby stretching the bent leg. A sitting user could stretch by twisting to one side while grasping the backrest for support. The abdominal muscles may be strengthened by grasping the hand-grips and raising both knees to the chest. Pushups can be performed using the seat as the push-up surface. The above movements may be further enhanced by utilizing the hand-grips 34 or the two footrests 32 or 40, as desired.

Figure 6:
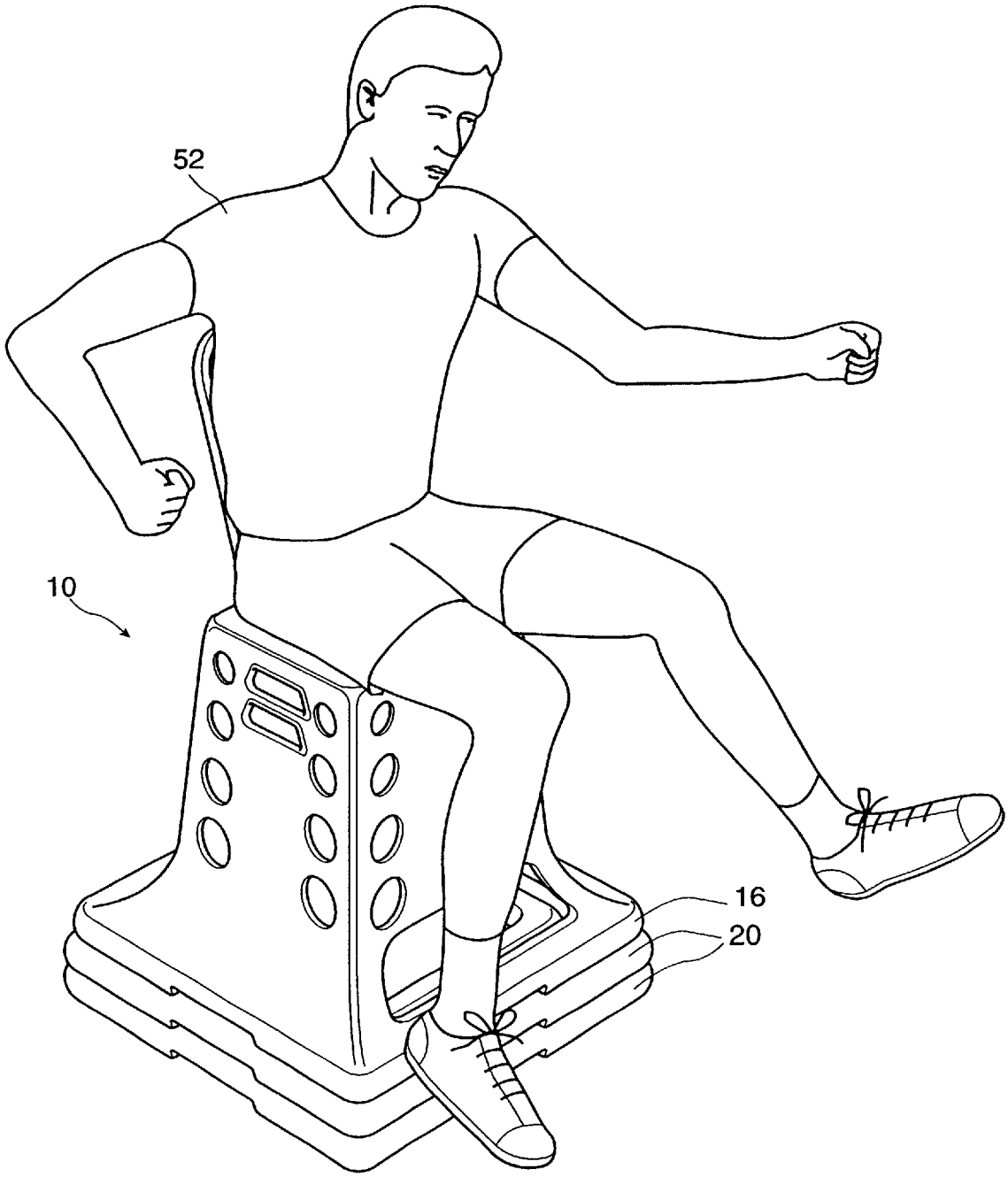
FIG. 6 is a schematic view of a human figure using the exercise chair of the present invention.

Aerobic exercise using the exercise device may be achieved by, for example, holding the backrest for support while jogging in place. Another example of aerobic exercise is demonstrated in FIG. 6, which shows an exerciser 52 punching and kicking while sitting in the exercise chair 10. It can be appreciated that the relatively narrow backrest provides ample freedom of arm movement, and the use of step-risers to set the chair to a convenient height allows for greater freedom of leg movement.

The freedom of movement and flexibility available while working out in the exercise chair makes it possible to perform sitting exercises that are analogous to, or variations of, most standing exercises. For example, jumping jacks could be performed in the exercise chair by swinging one's arms and legs out to the side, similar to the standing form of the exercise. Running on the spot could be replicated by moving the arms and legs in a circular or bicycle motion, similar to the movement shown in FIG. 6. It can therefore be appreciated that the exercise chair of the present invention enables sitting exercisers to participate in most conventional fitness classes, without concern for the stated fitness level, even where the instructor fails to provide any specific instructions directed to chair exercises.

It is also an advantage of the present invention that exercises performed while sitting in the exercise chair reduce the risk of injury to the weight bearing joints. Conventional fitness routines that involve movements such as jumping and stepping deliver a high impact to the joints, particularly the knees and hips, which can cause injury. Even "low impact" classes, by definition, deliver some impact. By contrast, there is little or no impact on the knees and hips of a sitting exerciser working out with the present invention. While the user's feet may push-off of the ground for some exercises, the pressure is modest and easily controlled. For example, a user with a sprained left ankle could push-off with the right foot when it is called for in an exercise movement, and not use the left foot at all.

It can now be appreciated that the exercise chair of the present invention provides people of all fitness levels with the security of knowing that they can conveniently take a standing or sitting rest break any time they become winded, tired, or otherwise unable to keep up during a fitness class. There is also the further benefit in that the exercisers taking such a rest break on the chair may, if they have the energy and desire, continue to follow the class at whatever pace they find suitable. The exercise chair therefore helps keep exercisers moving at all times, even if they are only capable of doing so to a limited degree. Reducing periods of inactivity is beneficial, as it helps prevent blood from pooling and enhances the exercise effect. When ready to return, less effort is needed to rise from the chair and re-join the class than that otherwise required to stand up from a sitting position on the floor. In this way the exercise chair adapts to meet each exerciser's particular needs, so that each exerciser can obtain his or her optimum personal exercise and health benefit.

Further, since the chair exercises may be performed to any desired level of intensity, there is no loss of exercise benefit. Thus the exercise chair can help even top athletes stay in shape when they might otherwise be sidelined due to standing-related injuries such as a sprained ankle or plantar fasciatus. In fact, athletes who are not even injured could choose to work out with the exercise chair to provide a change of pace or as a form of cross-training.

In time, fitness instructors may incorporate specific exercise chair movements into their routines. Exercises and stretches that would otherwise be unavailable in a conventional class, such as those that use the aid of a post, are particularly likely to be adopted. Further, special classes may be developed in which the entire workout is designed around the exercise chair.

The exercise chair could even be used in water fitness classes conducted in a swimming pool. For this application the exercise chair should be constructed from a material that is compatible with water. A plastic material as discussed above may be suitable, and in particular a plastic or other material that will not degenerate after repeated immersion in chlorinated swimming pool water is preferable.

Water fitness classes often involve exercisers standing in shallow water up to their waist. The water allows for low-impact jumping or jogging, but also requires participants to hunch over to contact the water for arm exercises. Using the exercise chair, exercisers can kick their legs while sitting comfortably and holding the hand-grips for stability. This provides the benefit of water resistance exercise without harmful joint impact. Also, since the chair seat height is lower than a user's waist the water contact level should be higher up the body. This may make it easier to do arm exercises in the water without hunching over.

It can also be appreciated that since the exercise chair is stackable and designed to be relatively lightweight, it should be possible to store the chairs in bulk in the same or similar storage area used for step-risers and other fitness equipment. The exercise chair should accordingly be conveniently integrated into the operations of most fitness clubs, and remain relatively inexpensive and convenient for home use.

It will be appreciated by those skilled in the art that the foregoing description is in respect of preferred embodiments and that various alterations and modifications are possible within the broad scope of the appended claims without departing from the spirit of the invention. For example, where it is desired to support a greater range of sitting or standing positions, a greater variety of extendible and retractable hand-grips could be incorporated into the exercise chair than in the examples provided. Additionally, chairs more specifically targeted to particular types of exercisers, such as wheelchair users, could be designed. Various other modifications will be apparent to those skilled in the art but are not described in any further detail herein.

I claim:

1. An exercise device for use in association with a step-riser having nestling features, said exercise device comprising:

(a) a support platform, to support a user;

(b) a backrest, extending above the support platform, to support a back of the user;

(c) a frame, extending below the support platform, to support the support platform; and (d) a base-engaging section, positioned below the frame, and having means sized and shaped for stably engaging the nestling features of the step-riser;

wherein, said support platform may be set to one or more predetermined heights above a flat surface to accommodate users of different sizes, by said exercise device being placed on the flat surface or on one or more of said step-risers.

2. The exercise device of claim 1, wherein the support platform, frame, and base-engaging section are sized and shaped to be nestable with a second exercise device, so that a stack of at least two exercise devices may be formed to facilitate storage of a plurality of said exercise devices.

3. The exercise device of claim 2, wherein the support platform, frame, and base-engaging section together define a hollow inner space.

4. The exercise device of claim 1, wherein the backrest is approximately 8 inches wide and 15 inches high.

5. The exercise device of claim 1, wherein said backrest is used as a support post sized, shaped, and positioned to support a standing exerciser making use of said support post for stretching and exercise.

6. The exercise device of claim 1, wherein the frame contains an opening on at least one side, said opening being sized and shaped to be nestable with the backrest of a second exercise device.

7. The exercise device of claim 1, wherein the support platform, frame, base-engaging section, and backrest are sized and shaped to be nestable with a second exercise device, so that a stack of at least two exercise devices may be formed to facilitate storage of a plurality of said exercise devices.

8. The exercise device of claim 1, further including hand grips positioned on opposite sides of the frame, for the user to grip while performing exercise from a seated position.

9. The exercise device of claim 1, further including a footrest opening on at least one sidewall of the frame, to provide a surface on which the user's feet can rest while said user is performing exercise from a seated position.

10. The exercise device of claim 1, wherein said frame is sized and shaped to accept straps for securing the user in the exercise device.

11. The exercise device of claim 1, wherein the support platform, frame, and base-engaging section are made of a moldable material such as plastic.

12. The exercise device of claim 1, wherein the support platform, frame, and base-engaging section are made of a material compatible with water.

13. A method of supporting a user performing exercise while in a seated position, said method comprising:

providing an exercise device for use in association with a step-riser having nestling features, said exercise device having a support platform to support the user, a backrest, extending above the support platform, to support a back of the user, a frame extending below the support platform, to support the support platform, and a base-engaging section, positioned below the frame, said base-engaging section having means sized and shaped for stably engaging the nestling features of the step-riser;

determining, from a group of one or more predetermined heights, a height above a flat surface at which to position the support platform, to accommodate the size of the user performing exercise from a seated position;

optionally providing and stacking one or more step-risers; and setting said base-engaging section on said flat surface or upon said stack of one or more step-risers, so that said support platform is positioned at the height above the flat surface previously determined to accommodate the size of the user performing exercise from a seated position.

14. The method of claim 13, wherein said flat surface is located at the bottom of a pool of water.

15. The exercise device of claim 1, wherein said nestling features include a riser-ledge, and the base-engaging section of the exercise device has a base-ledge sized and shaped to engage the riser-ledge.

16. The exercise device of claim 15, wherein the base-engaging section of the exercise device further includes a rubber strip along the base-ledge to reduce slippage.

17. The exercise device of claim 1, wherein said nestling features include a side-bar, and the base-engaging section of the exercise device has a side-indentation sized and shaped to engage the side-bar.

18. The exercise device of claim 1, wherein said nestling features include a plurality of footpad inlays, and the base-engaging section of the exercise device has a plurality of footpads sized and shaped to engage the plurality of footpad inlays.

19. The exercise device of claim 1, wherein said frame includes at least one aperture, each of said at least one aperture being sized and shaped to accept a strap.

* * * * *